US005765232A

United States Patent [19]

Pryor

[11] Patent Number: 5,765,232

[45] Date of Patent: Jun. 16, 1998

[54] BUSTLING HOOP

[76] Inventor: Dolores Pryor, 1304 Felton, Baytown, Tex. 77520

[21] Appl. No.: 825,979

[22] Filed: Apr. 4, 1997

[51] Int. Cl.[6] ..... A41D 1/16; A41D 27/00; A41D 27/22; A41D 27/08

[52] U.S. Cl. ..... 2/217; 2/216; 2/243.1; 2/336

[58] Field of Search ..... 2/52, 115, 144, 2/145, 212, 213, 217, 207, 216, 271, 279, 336, 312, 313, 314, 319; 24/66.9, 113 MP

[56] References Cited

U.S. PATENT DOCUMENTS

| | | | |
|---|---|---|---|
| 2,119,469 | 5/1938 | Kerngood | 2/336 |
| 3,064,268 | 11/1962 | Nania, Jr. | 2/217 |
| 4,774,726 | 10/1988 | Garrett | 2/105 |
| 4,788,723 | 12/1988 | Doelfel | 2/271 |
| 4,879,767 | 11/1989 | Hart | 2/243 |
| 5,005,218 | 4/1991 | Ganz | 2/115 |
| 5,156,023 | 10/1992 | Bevolo | 24/113 MP |
| 5,511,289 | 4/1996 | Melia | 24/66.9 |
| 5,630,231 | 5/1997 | Stevens | 2/217 |

*Primary Examiner*—Jeanette E. Chapman
*Attorney, Agent, or Firm*—Harrison & Egbert

[57] ABSTRACT

A device for supporting a train of a bridal gown having a hoop member with an interior area having a bar extending thereacross so as to define a first train receiving area and a second train receiving area within the hoop member and a clip connected to the hoop member so as to allow the hoop member to be affixed to a back side of the bridal gown. The bar extends generally horizontally across an interior area of the hoop member. The first train receiving area has a size and shape matching the second train receiving area. The clip member has a surface affixed to the back side of the hoop member. The hoop member is formed of a rigid material which is covered with a fibrous material.

9 Claims, 4 Drawing Sheets

BUSTLING HOOP

TECHNICAL FIELD

The present invention relates to devices for supporting a train of a bridal gown above the ground. More particularly, the present invention relates to devices which allow the bridal gown to maintain the train in a safe and comfortable position.

BACKGROUND ART

Dresses, particularly wedding dresses, may have a train or trailing portion that extends behind the dress wearer. This dress train may make walking unnecessarily difficult if the train is not properly positioned behind the dress wearer. Dress train hoops have been used in the past to help dress wearers control and adjust the position of the trailing or train portion of the dress. Train hoops of the prior art normally consist of a circular hoop. To use the dress train hoop, the train of the dress is inserted through the hoop and the hoop itself is held to help control the positioning of the dress train.

Unfortunately, such dress train hoops are nearly as inconvenient as the train itself. Such a train hoop requires that the wearer hold the train and the hoop. This can be very difficult when attending receptions or greeting others in reception lines.

In other circumstances, crocheted loops are affixed onto the bridal gown. These loops will correspond with buttons that are sewn onto the back seam around the waist. As such, the train can be held in position by placing each of the loops around the buttons. In other circumstances, hook-and-eye arrangements will also serve for retaining the train in a proper position. Unfortunately, it is often time consuming and difficult to install and utilize such loop/button configuration or such loop-and-eye configurations. In many circumstances, these devices create an unpleasant appearance. This is particularly a problem when multi-layer tulle dresses are used at the wedding. Such crocheted loops and buttons will adversely affect the appearance and effect of the tulle dress. This adverse appearance is the result of tacking the multiple layers of the tulle dress together during the affixing of the loops. During a wedding ceremony, such a configuration will not "flow" down the aisle. It will present an appearance much like a tufted button on a couch. As such, such arrangements are undesirable for tulle dresses.

In the past, various U.S. patents have issued relating to devices for supporting the train of a wedding gown. For example, U.S. Pat. No. 5,052,059, issued on Oct. 1, 1991, to N. D. Speer teaches the use of a wrist strap that enables the bride or dress wearer to carry and support the hoop of the wedding gown train around the wrist. In particular, the wedding train hoop entails a hoop having a first and second end connected together by a friction pin or screw. A decorative sock is disposed around the hoop and includes a wrist section that is formed at the junction of the first and second ends of the hoop and extends from the hoop to form a wrist strap or loop.

U.S. Pat. No. 5,546,606, issued on Aug. 20, 1996, to T. J. Luckabaugh teaches an adjustable bridal train. This adjustable bridal train includes a skirt web forming a portion of the bridal gown which continues into a train web for trailing behind the bridal gown during the wedding proceeding. Retracting assemblies are secured to inner surfaces of the train web for effecting a pleating and shortening of the train web to a length substantially equal to a length of the skirt web so as to hang the train from the gown and preclude trailing of the train web along the ground surface.

It is an object of the present invention to provide a device for supporting the train of a wedding gown which can be conveniently used so as to "bustle" the train above the ground.

It is another object of the present invention to provide a device for supporting the train of a wedding gown which can be easily applied to the back of the wedding gown.

It is another object of the present invention to provide a device for supporting the train of a wedding gown which will not adversely affect the appearance of tulle dresses.

It is still another object of the present invention to provide a device for supporting the train of a wedding gown which is virtually invisible when in use.

It is another object of the present invention to provide a device for supporting the train of a wedding gown which is relatively inexpensive, easy to use and easy to manufacture.

These and other objects and advantages of the present invention will become apparent from a reading of the attached specification and appended claims.

SUMMARY OF THE INVENTION

The present invention is a method and device for supporting the train of a bridal gown. In particular, the device of the present invention includes a hoop member having an interior area with a bar extending thereacross. The bar defines a first train receiving area and a second train receiving area within the hoop member. A means is provided for affixing the hoop member to the bridal gown. This means for affixing is located on the back side of the hoop member.

The hoop member is of a generally round configuration. The bar extends horizontally across the hoop member when the hoop member is affixed to the bridal gown. As a result, the first train receiving area will be above the second train receiving area with the hoop member. The bar will extend centrally across the hoop member.

The hoop member is formed of a material with a color matching a color of the bridal gown. In the preferred embodiment of the present invention, this hoop member is formed of a polymeric material. The polymeric material can be covered with a polyfiber covered with satin.

The means for affixing is a clip member having a surface affixed to the hoop member. This clip member can be a safety pin which is removably affixable to the bridal gown.

The method of supporting the train of the bridal gown in accordance with the present invention comprises the steps of: (1) forming a hoop member having a central open area with a bar extending thereacross so as to define the first and second train receiving areas; (2) affixing the hoop member to the back of the bridal gown; (3) inserting the train through the first train receiving area so that the train extends over the bar; and (4) pulling the train through the second train receiving area.

In this method, the train can be pouffed outwardly of the hoop member such that the train generally conceals the hoop member from exterior view. This is accomplished by pulling the edges of the train of the bridal gown outwardly beyond the outer diameter of the hoop member.

The step of inserting the bridal gown into the hoop member includes the steps of lifting the train such that an end of the train extends above the ground, and then threading the end of the train through the first train receiving area. Specifically, the end of the train is inserted through a back of the hoop member and then the end of the train is pulled from the back of the hoop member through the first train receiving area to the front of the hoop member. This pulled end of the train is then inserted from the front of the hoop member through the second train receiving area. The amount of the train which extends outwardly from the front of the hoop member will determine how high above the ground the end of the train extends.

DETAILED DESCRIPTION OF THE INVENTION

Figure 1:
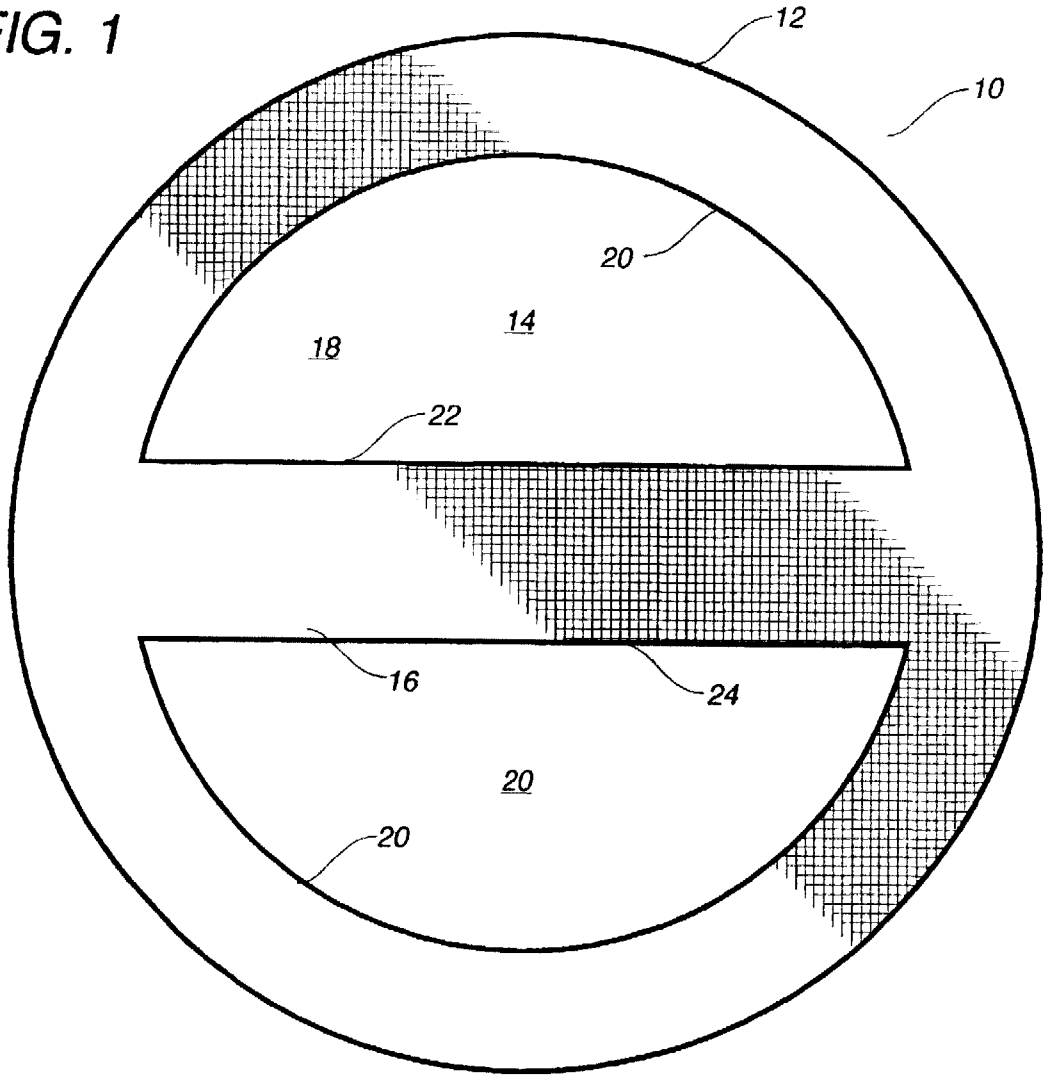
FIG. 1 is a frontal view of the device for supporting the train of a bridal gown in accordance with the present invention.

Referring to FIG. 1, there is shown at 10 the device in accordance with the present invention for supporting the train of a bridal gown. In particular, the device 10 includes a hoop member 12 having an interior area 14 with a bar 16 extending thereacross. The hoop member 12 and the bar 16 define a first train receiving area 18 and a second train receiving area 20 on opposite sides of the bar member 16. In the present invention, the hoop member 12 has a generally round or valentine heart-shaped configuration. The bar 16 extends across the hoop member 12 in a horizontal orientation such that the first train receiving area 18 is positioned above the second train receiving area 20.

The first train receiving area 18 is defined by the inward edge 22 of the hoop member 12 and an exterior edge 22 of the bar 16. The second train receiving area 20 is defined by the inner surface 20 of the hoop member 12 and another edge 24 of the bar 16. Each of the first train receiving area 18 and the second train receiving area 20 have an identical shape and size. In particular, in the preferred embodiment of the present invention, as shown in FIG. 1, the first train receiving area 18 and the second train receiving area 20 have a generally semi-circular configuration. In normal use, the hoop member 12 is formed of a rigid material such as wood or plastic. The hoop member 12 can be covered with a material so as to have a color matching the color of the bridal gown. As will be described hereinafter, the rigid material which forms the hoop member 12 can be covered with a polyfiber material which is covered, on the exterior, with satin material.

As used herein, the term "hoop member" refers to various geometric configurations that have an interior opening. For example, and without limitation, the term "hoop member" can include square shapes, triangular shapes, hexagonal shapes, octagonal shapes, oval shapes, valentine-heart shapes, trapezoidal shapes and the like.

Figure 2:
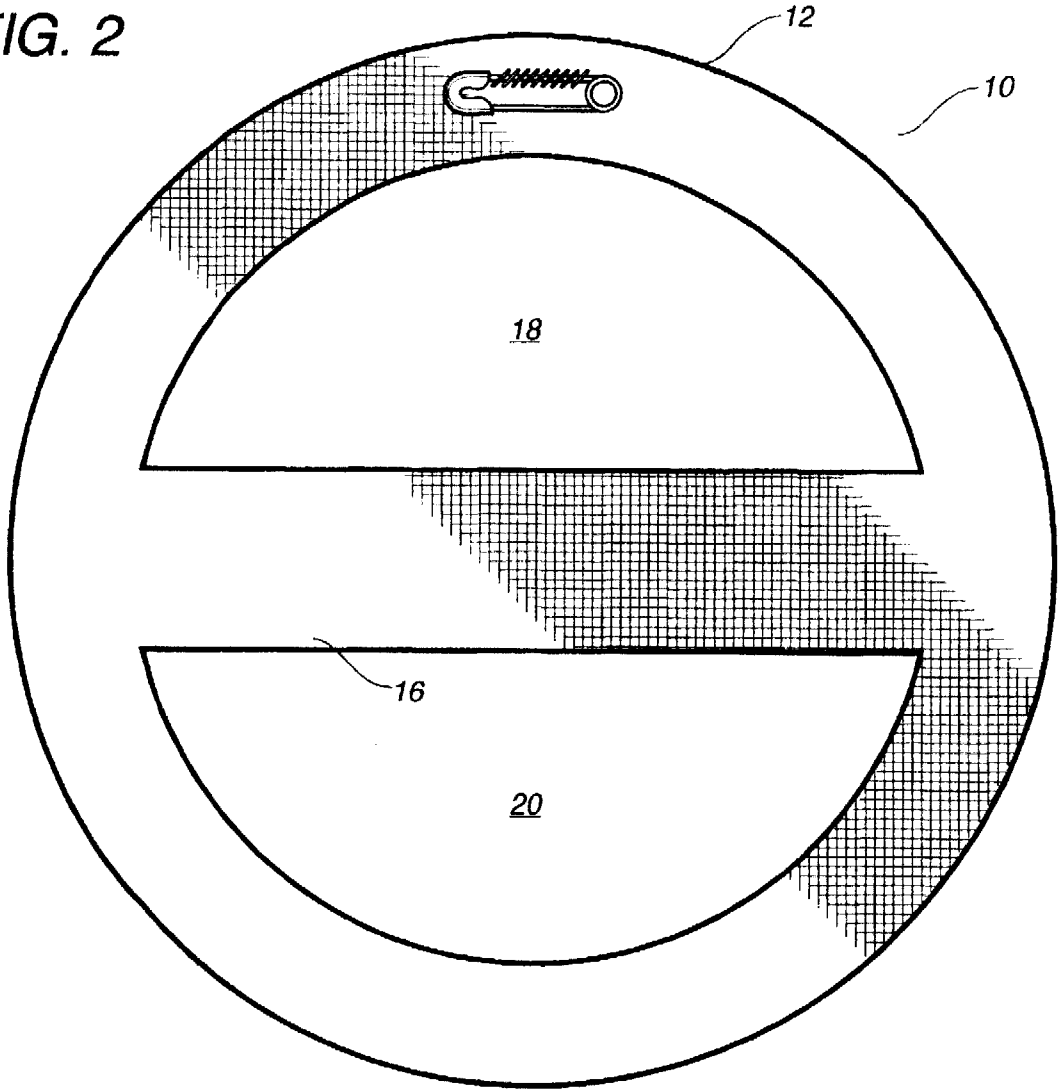
FIG. 2 is a back view of the device for supporting the train of a bridal gown in accordance with the present invention.

FIG. 2 shows a back view of the device 10 of the present invention. It can be seen that the hoop member 12 has a clip 26 affixed thereto. Clip 26 is the means for affixing the hoop member 12 to the bridal gown. In particular, the clip 26 is illustrated as being a safety pin which has a portion received by the hoop member 12 and has a clip portion 28 which can be secured to the back of the wedding gown. As such, the hoop member 12 can be removably affixed to the back of the wedding gown. Although the clip member 26 is illustrated in FIG. 2, it is important to realize that various alternatives are possible within the scope of the present invention. For example, various other attachments such as buttons, loops, hooks, adhesives, or other related materials can be used so as to properly secure the back side of the hoop member 12 to the back of the wedding gown. The clip member 26 is specified since it can be easily and quickly applied to the back of the wedding gown without undue time and effort. It can also be easily removed without damage to the wedding gown.

Figure 3:
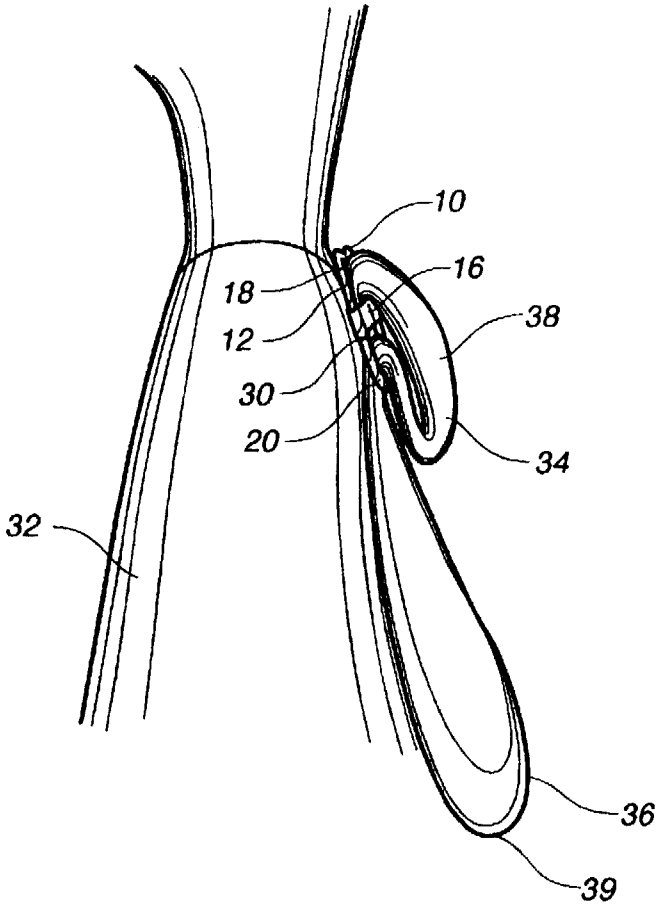
FIG. 3 is a side view showing the device of the present invention as applied to the back of a bridal gown.

FIG. 3 shows the method of the present invention in which the device 10 is secured to the back side 30 of wedding gown 32. In particular, it can be seen that the train 34 of the wedding gown 32 will extend through the interior of the device 10. The train 34 will have a portion 36 which extends downwardly from the bottom of the device 10. Unlike the normal position of the train 34, the device 10 will cause the portion 36 to be lifted, a desired distance, above the ground.

In FIG. 3, it can be seen that the hoop member 12 is affixed to the back 30 of the bridal gown 32. Initially, the train 34 is inserted through the first train receiving area 18 so that the train 34 will extend over the bar 16. The bottom portion 36 of the train 34 is then pulled through the second train receiving area 20. As such, it is possible to have a bustled portion 38 which extends outwardly of the side of the hoop member 12 opposite the back 30 of the bridal gown 32. This bustling of the train 34 will serve to conceal the device 10 from exterior view.

In particular, in the method of the present invention, the end 39 of the train 34 is lifted and then threaded through the first train receiving area 18 of the device 10. In particular, the end 39 is inserted through the back of the hoop member 12 and then pulled from the back of the hoop member 12 through the first train receiving area 18 to a front of the hoop member 12. This pulled end 39 is then inserted through the front of the second train receiving area 20 and pulled toward the back of the hoop member 12. The end 39 can then be pulled downwardly, for a desired distance, such that the bustled portion 38 will have a desired size.

Figure 4:
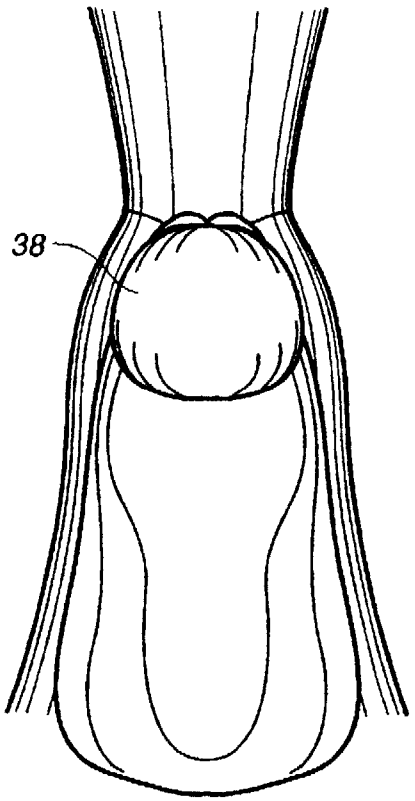
FIG. 4 is a rear view showing the device as applied to the back of a wedding gown.

FIG. 4 shows how the bustled portion 38 of the train 34 effectively conceals the device from exterior view. So as to create this bustling effect, the edges of the train 34 should be pouffed outwardly beyond the outer diameter of the hoop member 12.

Figure 5:
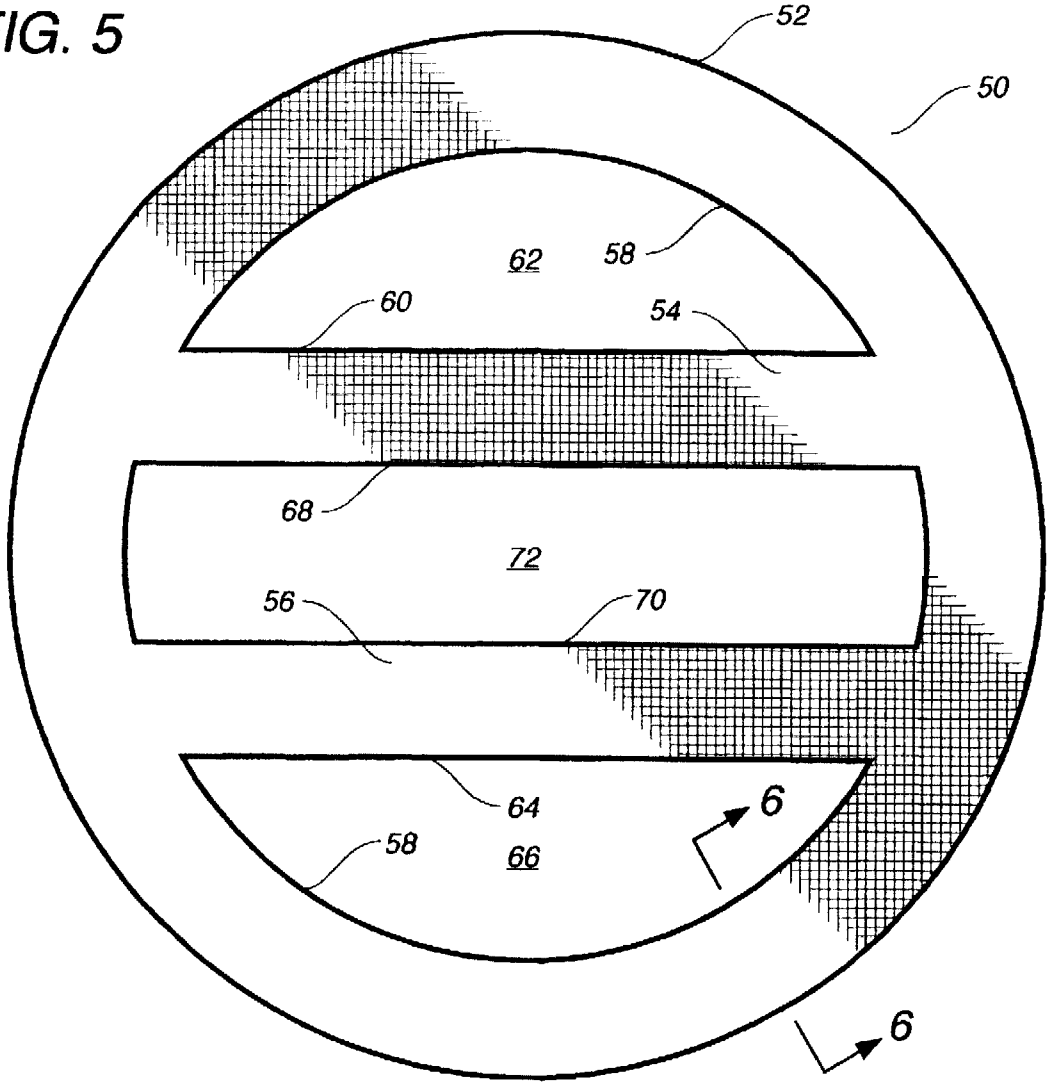
FIG. 5 is a frontal view showing an alternative embodiment of the present invention.

FIG. 5 shows an alternative embodiment of the device 50 in accordance with the teachings of the present invention. The device 50 includes a hoop member 52 having a first bar 54 and a second bar 56 extending horizontally thereacross. The inner edge 58 of the hoop member 52 and the edge 60 of the first bar 54 defines an upper train receiving area 62. The area between the edge 58 of the hoop member 52 and the edge 64 of the second bar 56 defines a lower train receiving area 66. Finally, the area between an inner edge 68 of the first bar 54 and an upper edge 70 of the second bar 56 defines a central train receiving area 72.

The device 50 is employed so as to create a "double pouff" effect. In use, the train is initially inserted from the back of the central train receiving area 72, pulled outwardly and inserted into the front of the lower train receiving area 66. The train is then pulled backwardly and upwardly such that the end of the train will enter the upper train receiving area 62. The end of the train can then be pulled through the upper train receiving area 62 so as to extend outwardly over the first bar 54 and the second bar 56 so as to effectively conceal the device 50.

Figure 6:
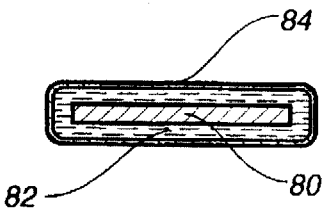
FIG. 6 is a cross-sectional view taken across lines 6—6 of FIG. 5.

FIG. 6 shows a cross-sectional view of the device 50. The cross-sectional view shown in FIG. 6 is also illustrative of the cross-sectional view of the device 10, as shown in FIGS. 1 and 2.

In particular, it can be seen that the device 50 is initially formed of a formed section of rigid material 80. A polyfiber 82 will extend around the exterior of the rigid material 80. Finally, a layer of satin 84 can be applied to an exterior of the polyfiber material 82. The satin material 84 should have a color generally matching the color of the bridal gown. This arrangement creates the appearance of a soft supporting device. It also serves to eliminate any sharp edges that could adversely effect or tear the bridal gown and/or train.

The present invention solves a number of the problems associated with existing devices used to support the train of a bridal gown above the earth. First, and foremost, the device can be easily applied to the back of a bridal gown. This avoids any unnecessary manipulation and effort during the times of extreme stress, such as a wedding. Furthermore, the device creates a pleasant "bustling" effect on the train by extending the train outwardly in the form of a bustle. The end of the train is effectively lifted off of the ground by the forming of this bustle. The device can be easily manufactured out of inexpensive material. Once the train is effectively installed within the device 10, the bride can use both of her arms in a normal fashion to greet and welcome friends and family. The present invention will not effect the flowing cloud-like appearance of tulle dresses.

The foregoing disclosure and description of the invention is illustrative and explanatory thereof. Various changes in the details of the illustrated apparatus construction may be made within the scope of the appended claims without departing from the true spirit of the invention. The present invention should only be limited by the following claims and their legal equivalents.

I claim:

1. A method for supporting a train of a bridal gown comprising the steps of:

forming a hoop member having a central open area with a bar extending thereacross so as to define a first train receiving area and a second train receiving area;

affixing said hoop member to a back of the bridal gown;

inserting the train through the first train receiving area so that said train extends over said bar; and pulling the train through said second train receiving area.

2. The method of claim 1, further comprising the step of:

pouffing the train outwardly of said hoop member such that the train generally conceals said hoop member from exterior view.

3. The method of claim 1, said step of inserting comprising the steps of:

lifting the train such that an end of the train extends above the ground; and threading said end of the train through said first train receiving area.

4. The method of claim 3, said step of threading comprising the steps of:

inserting said end through a back of said hoop member;

pulling said end through to a front of said hoop member; and inserting the pulled end of the train into said second train receiving area from a front of said hoop member.

5. The method of claim 2, said step of pouffing comprising:

pulling edges of the bridal gown outwardly beyond an outer diameter of said hoop member.

6. The method of claim 1, said step of forming comprising:

forming said hoop member so as to have a generally valentine-heart shape.

7. The method of claim 1, said step of affixing comprising:

clipping a back surface of said hoop member to said back of said bridal gown below a waist of the bridal gown.

8. The method of claim 1, said step of forming comprising the steps of:

shaping the hoop member out of a rigid material; and covering the shaped hoop member with a fibrous material having a color generally matching a color of the bridal gown.

9. The method of claim 4, said first train receiving area positioned above said second train receiving area within said hoop member.

* * * * *